US006863589B2

(12) United States Patent
Cano

(10) Patent No.: US 6,863,589 B2
(45) Date of Patent: Mar. 8, 2005

(54) TUBE BRASSIERE AND METHOD OF MAKING

(75) Inventor: Carlos Alberto Cano, Estado de Mexico (MX)

(73) Assignee: Sara Lee Corporation, Winston-Salem, NC (US)

( * ) Notice: Subject to any disclaimer, the term of this patent is extended or adjusted under 35 U.S.C. 154(b) by 0 days.

(21) Appl. No.: 10/406,789

(22) Filed: Apr. 3, 2003

(65) Prior Publication Data

US 2004/0224605 A1 Nov. 11, 2004

(51) Int. Cl.[7] ..... A41C 3/00

(52) U.S. Cl. ..... 450/65; 450/41

(58) Field of Search ..... 450/1, 65, 66, 450/79, 82, 93, 92, 58, 41, 45–49, 51, 52; 66/171, 176, 177, 153, 172 E, 170, 169 R, 172 R, 173, 175; 2/67, 69, 73, 105, 106, 113–115

(56) References Cited

U.S. PATENT DOCUMENTS

| | | | | | |
|---|---|---|---|---|---|
| 1,328,586 | A | | 1/1920 | Olson | |
| 1,431,206 | A | | 10/1922 | Yurka | |
| 1,724,728 | A | | 8/1929 | Rothman | |
| 2,013,110 | A | | 9/1935 | Rosenthal | 66/176 |
| 2,352,866 | A | | 7/1944 | Stacy | 2/42 |
| 2,458,696 | A | | 1/1949 | Elias | 2/42 |
| 2,498,487 | A | | 2/1950 | Elias | 2/42 |
| 3,421,513 | A | | 1/1969 | Landau | 128/443 |
| 3,537,279 | A | | 11/1970 | Epley | 66/176 |
| 3,704,469 | A | | 12/1972 | Levy | 2/67 |
| 3,718,143 | A | | 2/1973 | Pagano et al. | 128/499 |
| 3,772,899 | A | * | 11/1973 | Novi | 66/176 |
| 4,531,525 | A | * | 7/1985 | Richards | 450/65 |
| 4,583,544 | A | | 4/1986 | Flanagan et al. | 128/482 |
| 4,617,934 | A | | 10/1986 | Hittel | 128/425 |
| 4,909,771 | A | | 3/1990 | Bergman | 450/3 |
| 5,120,264 | A | | 6/1992 | Van Engel | 450/7 |
| 5,162,015 | A | | 11/1992 | Otani | 450/7 |
| D336,351 | S | | 6/1993 | Freese et al. | D2/706 |
| 5,269,720 | A | | 12/1993 | Moretz et al. | 450/37 |
| 5,385,502 | A | | 1/1995 | Moretz et al. | 450/93 |
| 5,479,791 | A | * | 1/1996 | Osborne | 66/171 |
| 5,553,468 | A | * | 9/1996 | Osborne | 66/171 |
| 5,592,836 | A | * | 1/1997 | Schuster et al. | 66/176 |
| 5,850,745 | A | | 12/1998 | Albright | 66/17 |
| 5,944,579 | A | * | 8/1999 | Fleischman | 450/69 |
| 5,946,944 | A | * | 9/1999 | Osborne | 66/176 |
| 6,015,331 | A | | 1/2000 | Ioakim | 450/37 |
| 6,082,145 | A | * | 7/2000 | Lonati et al. | 66/176 |
| 6,125,664 | A | * | 10/2000 | Browder, Jr. | 66/176 |
| 6,178,784 | B1 | * | 1/2001 | Marley, Jr. | 66/173 |
| 6,192,717 | B1 | | 2/2001 | Rabinowicz | 66/177 |
| 6,276,175 | B1 | | 8/2001 | Browder, Jr. | 66/171 |
| 6,287,168 | B1 | * | 9/2001 | Rabinowicz | 450/75 |
| 6,550,286 | B2 | | 4/2003 | Querquant | 66/176 |
| 2002/0155786 | A1 | | 10/2002 | Querquant | 450/93 |
| 2003/0171066 | A1 | | 9/2003 | Mitchell et al. | 450/66 |
| 2003/0230120 | A1 | | 12/2003 | Mitchell et al. | 66/171 |

FOREIGN PATENT DOCUMENTS

| | | |
|---|---|---|
| DD | 1920 125 | 4/1969 |
| GB | 2 291 782 A | 2/1996 |
| MX | 94092 | 3/1994 |
| MX | 94311 | 9/1994 |
| MX | 9500770 | 8/1995 |
| MX | 9600206 | 5/1996 |
| MX | 192057 | 6/1996 |
| MX | 9602390 | 6/1996 |
| MX | 9602840 | 7/1996 |
| MX | PA/u/1997/000061 | 2/1997 |
| MX | PA/u/1998/000084 | 3/1998 |
| MX | PA/u/1998/000334 | 11/1998 |
| MX | PA/u/1999000163 | 6/1999 |

* cited by examiner

*Primary Examiner*—Gloria M. Hale
(74) *Attorney, Agent, or Firm*—Ohlandt, Greeley, Ruggiero & Perle, L.L.P.

(57) ABSTRACT

A tube brassiere is formed from a circularly knitted garment blank. The blank has an internal dimension, a length, and a pair of breast cup defined therein. The length of the blank encircles a torso of a wearer.

22 Claims, 4 Drawing Sheets

TUBE BRASSIERE AND METHOD OF MAKING

BACKGROUND OF THE INVENTION

1. Field of the Invention

The present invention relates to brassieres. More particularly, the present invention relates to a tube brassiere or bra and a method of making a tube brassiere.

2. Description of Related Art

A brassiere is used to support the breasts of the wearer. A brassiere typically has a body-encircling portion and a pair of breast cups. The body-encircling portion is adapted to wrap around the upper torso of the wearer. The breast cups are positioned in the body-encircling portion so that the wearer's breasts are received in and supported by the breast cups.

Bras can also include other components such as an underwire or other supporting structure along the lower periphery of the breast cups. The underwire can aid in supporting the wearer's breasts. Bras can also have one or more shoulder straps connected to the body-encircling portion. The straps can transfer at least a portion of the support function to the wearer's shoulders.

It can be desired to minimize the number of seams and other garment discontinuities in undergarments. Seams and garment discontinuities can be physically and/or aesthetically unpleasing. For example, seams in a brassiere can chaff, exert pressure points and, thus, can be a source of physical discomfort. In addition, seams in a brassiere or an undergarment can often be visible through outer clothing, which normally is aesthetically unpleasing.

Accordingly, there is a need for a substantially seamless brassiere that is easy to manufacture and assemble.

BRIEF SUMMARY OF THE INVENTION

It is an object of the present invention to provide a seamless tube brassiere.

It is another object to provide a simple, easy to manufacture tube brassiere.

It is still a further object of the present invention to provide a tube brassiere made from a hosiery blank.

These and other objects and advantages of the present invention are achieved by a tube brassiere made of a circularly knitted garment blank. The circularly knitted garment blank has an internal dimension, a length sufficient to encircle a torso of a wearer, and a pair of breast cups defined in the length.

These and other objects and advantages of the present invention are also achieved by a tube brassiere having a seamless cylindrical body encircling portion, a pair of breast cups, and a securing member. The body-encircling portion has a length sufficient to encircle a torso of a wearer, a first end, a second end, and an inner dimension. The breast cups are defined in the body-encircling portion. The securing member secures the first and second ends to one another so that the body-encircling portion can be retained about the torso.

The present invention further provides a method of making a tube brassiere. The method includes forming a seamless cylindrical member having a first end, a second end, and a length defined between the first and second ends; and defining a pair of breast cups in the length. Here, the length is sufficient to encircle a torso of a wearer.

The above-described and other features and advantages of the present invention will be appreciated and understood by those skilled in the art from the following detailed description, drawings, and appended claims.

DETAILED DESCRIPTION OF THE INVENTION

Figure 1:
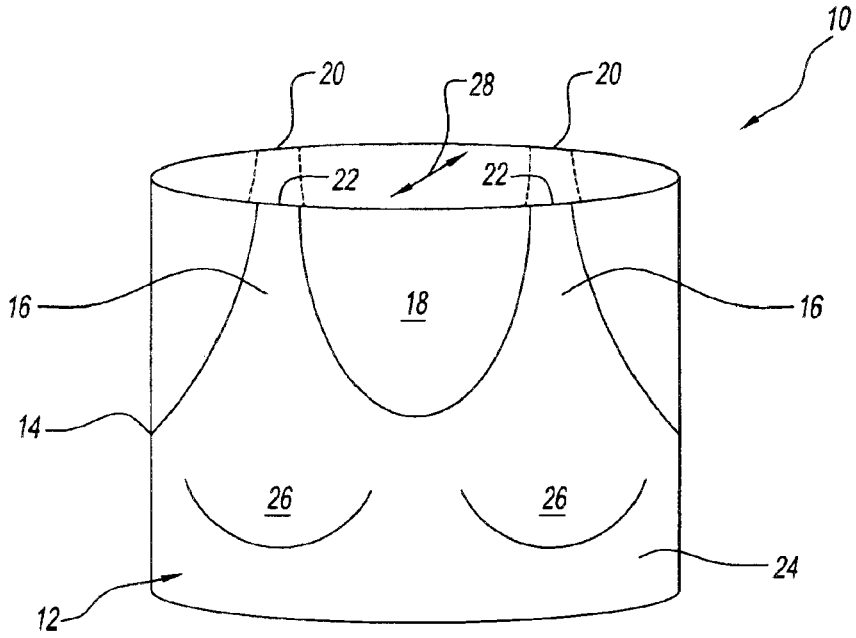
Fig. 1 (Prior Art)
FIG. 1 is a perspective view of a prior art brassiere formed from a cylindrical garment blank.

Referring now to the drawings and in particular to FIG. 1, a prior art brassiere 10 formed from a cylindrical garment blank 12 is illustrated. Blank 12 is formed by a circular knitting processes, such as those that have found wide use in the production of a variety of clothing items, such as a pair of pantyhose, a sock, a pair of stockings, a brassiere, a blouse, a leotard, a swimsuit, a pair of panties, a pair of men's underwear, and other garments or apparel. Blank 12 can be manufactured by commercially available equipment, such as the SANTONI HFVM or HF4.7 knitting machines.

In some prior brassieres 10, blank 12 was trimmed along a cut line 14 to define a pair of shoulder straps 16 and a neck opening 18. Each strap 16 defined a pair of edges 20 and 22. Brassiere 10 was formed by joining edges 20 to edges 22. Thus, brassiere 10 defines a body-encircling portion 24. Brassiere 10 can have breast cups 26 formed therein by, for example, a known cup molding process.

Accordingly, brassiere 10 includes seams at edges 20, 22. In these prior brassieres 10, cylindrical blank 12 has an internal dimension 28 sufficient in size to be received over the torso of the wearer.

The equipment that manufactures cylindrical blank 12 with internal dimension 28 sufficient to be received over the torso of the wearer is often very expensive. This equipment oftentimes can not be used to manufacture garments having smaller internal dimensions.

However, circular-knitting equipment that can manufacture a cylindrical blank with an internal dimension sufficient in size for hosiery products is commonplace around the world. These smaller dimension cylindrical blanks can be used to make a variety of hosiery products, such as a sock, a pair of stockings, and a pair of pantyhose.

Figure 2:
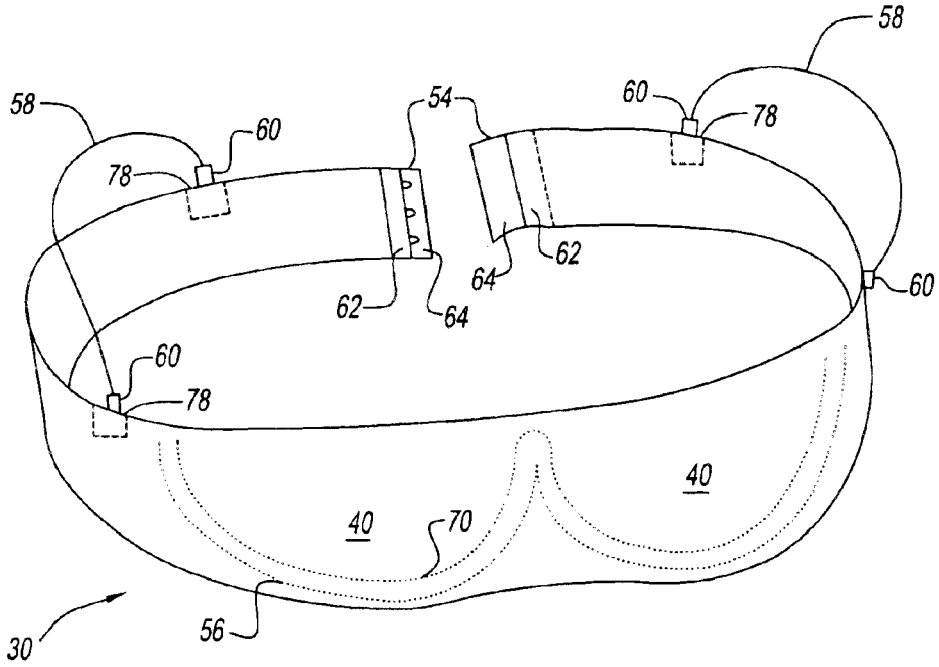
FIG. 2 is a perspective view of a tube brassiere according to the present invention.
Figure 3:
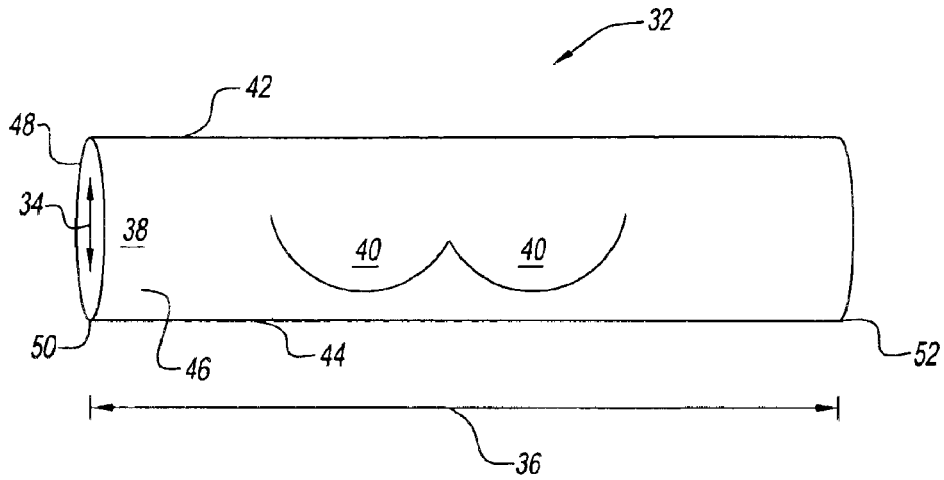
FIG. 3 is a perspective view of a cylindrical garment blank used in the manufacture of the tube brassiere of FIG. 2.

Referring now to FIGS. 2 and 3, a substantially seamless tube brassiere 30 according to the present invention and a cylindrical garment blank 32 used to form the tube brassiere are illustrated.

Blank 32 is, preferably, a hosiery blank. Thus, blank 32 has an internal dimension 34 sufficient in size for a hosiery product. Accordingly, internal dimension 34 is not sufficient to fit over a person's torso. Rather, internal dimension 34 is sufficient to fit over, for example, one leg of a person. Blank 32 can therefore be made using the circular-knitting equipment used for hosiery products.

Blank 32 is formed of a synthetic material, a natural material, or any combinations thereof. Preferably, blank 32 is formed of one or more circularly knitable elastic materials such as, but not limited to, nylon and LYCRA.

Advantageously, blank 32 defines a body-encircling portion 38 without the need for the cut lines of prior brassieres. Rather, blank 32 has a desired length 36, which is, preferably, sufficient to wrap around a person's torso. Thus, length 36 of blank 32 defines a body-encircling portion 38, which is seamless.

Blank 32 also includes a pair of breast cups 40 defined in body-encircling portion 38. Breast cups 40 can have a knitted cup depth, which is a common technique used in hosiery blank manufacture for the heel of the wearer. Alternately, breast cups 40 can have a molded cup depth by molding the breast cup in blank 32 in any known manner.

Preferably, body-encircling portion 38 has a substantially constant, minimum width around the body. In addition, body-encircling portion 38 preferably has elastic properties that can hold tube brassiere 30 against the body, as well as provide support to the wearer's breasts.

Blank 32 is laid flat along its length to define an upper edge 42, a lower edge 44, a body facing layer 46, and a clothes facing layer 48 of tube brassiere 30. Thus, tube brassiere 30 has two layers, which can be reversible. For example, tube brassiere 30 can have a first color or pattern on layer 46 and a second color or pattern on layer 48.

Blank 32 defines a first end 50 and a second end 52, which provide access to internal dimension 34. Thus, blank 32 allows one or more brassiere components to be inserted in inner dimension 34 of the blank through ends 50, 52. By way of example, the brassiere components can include a fastener 54, an underwire 56, a shoulder strap 58, and a strap-securing member 60.

Figure 4:
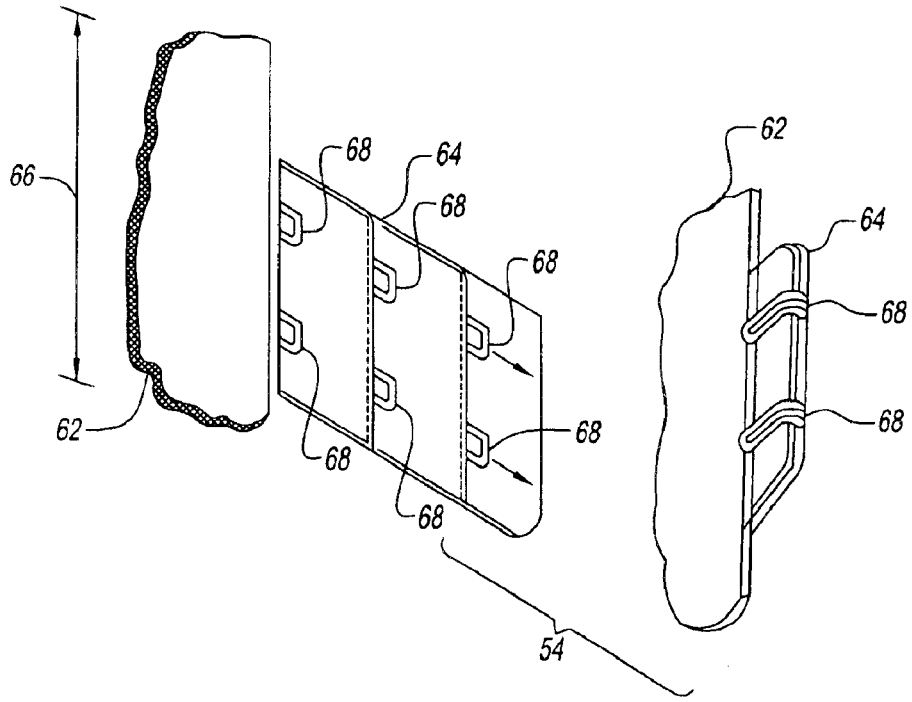
FIG. 4 is a perspective view of a fastener used in the manufacture of the tube brassiere of FIG. 2.

In one embodiment of the present invention, tube brassiere 30 includes a fastener 54. Fastener 54 enables the wearer to easily fasten/unfasten tube brassiere 30 from their body. Fastener 54, described with reference to FIG. 4, have a first portion 62 and a second portion 64.

First portion 62 has a width 66 sufficient to be received in inner dimension 34 of blank 32. First portion 62, preferably, has a heat fusible material or a heat curable adhesive. Thus, fasteners 54 are secured to blank 32 by inserting first portion 62 in inner dimension 34 at ends 50, 52 and heating the ends to secure the first portion to the blank. Additionally, securing fasteners 54 in ends 50, 52 can seal the ends.

In this position, second portion 64 extends outwardly from blank 32. Second portion 64 includes one or more connectors 68 disposed thereon. Connectors 68 are connectable to each other in a known manner to easily fasten/unfasten tube brassiere 30. For example, connectors 68 can include "hook and eye" type connects as illustrated, zippers, snaps, "hook-tape" strips (e.g., VELCRO), and others.

It should also be recognized that fasteners 54 are described above by way of example as being secured to blank 32 by way of a heat fusible material or a heat curable adhesive. Of course, it is contemplated by the present invention for fasteners 54 to be secured to blank 32 by other methods, such as, but not limited to sewing and adhesives.

Tube brassiere 30 can include an underwire 56 for aiding in support of the breasts of the wearer. Underwire 56 can be disposed in inner dimension 34 through ends 50, 52 prior to sealing the ends with fasteners 54.

Underwire 56 is disposed in inner dimension 34 along a lower periphery 70 of breast cups 40. For purposes of clarity, underwire 56 is illustrated as a unitary member. Of course, it is contemplated by the present invention for underwire 56 to be separated into separate halves.

Preferably, underwire 56 also has a heat fusible material or a heat curable adhesive. Thus, underwire 56 can be secured in inner dimension 34 of blank 32 through the application of heat. This application of heat can occur simultaneous or subsequent to heating blank 32 to secure fasteners 54 thereto.

It is contemplated by the present invention for underwire 56 to be secured to an exterior of layers 46, 48 by adhesives, heat fusible materials, sewing, and any other securing method to secure the underwire to the layers.

Figure 5:
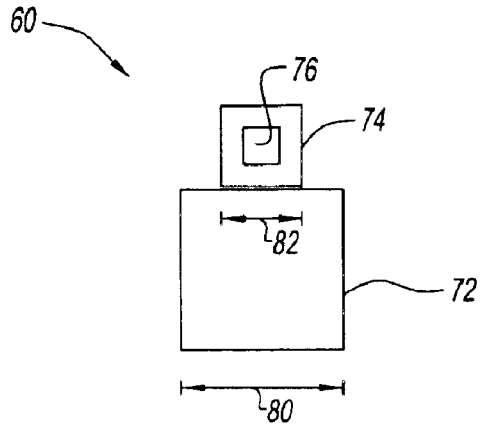
FIG. 5 is a side view of a strap-securing member used in the manufacture of the tube brassiere of FIG. 2.

Also illustrated in FIG. 2, tube brassiere 30 includes strap-securing members 60 for securing straps 58 to body-encircling portion 38. Strap-securing members 60, illustrated in FIG. 5, have a first portion 72 and a second portion 74, which defines an opening 76 for receiving strap 58.

Strap-securing members 60 can be disposed in inner dimension 34 through ends 50, 52 prior to sealing the ends with fasteners 54. Here, body-encircling portion 38 has a slit 78 defined at desired locations along length 36. First portion 72 has a width 80 that is, preferably, larger than slit 78, while second portion 74 has a width 82 that is smaller than slit 78. Thus, strap-securing members 60 are sized so that second portion 74 extends from body-encircling portion 38, while first portion 72 is retained in inner dimension 34.

First portion 72, preferably, also has a heat fusible material or a heat curable adhesive. Thus, strap-securing members 60 can be secured in inner dimension 34 of blank 32 through the application of heat. Again, this application of heat can occur simultaneous or subsequent to heating blank 32 to secure fasteners 54 and/or underwire 56 thereto.

After strap-securing members 60 have been secured to body-encircling portion 38, straps 58 can be removably connected through openings 76. Thus, tube brassiere 30 can easily be converted from a strapped configuration when straps 58 are connected to strap-securing members 60 to a strapless configuration when straps 58 are removed from the strap-securing members.

Figure 6:
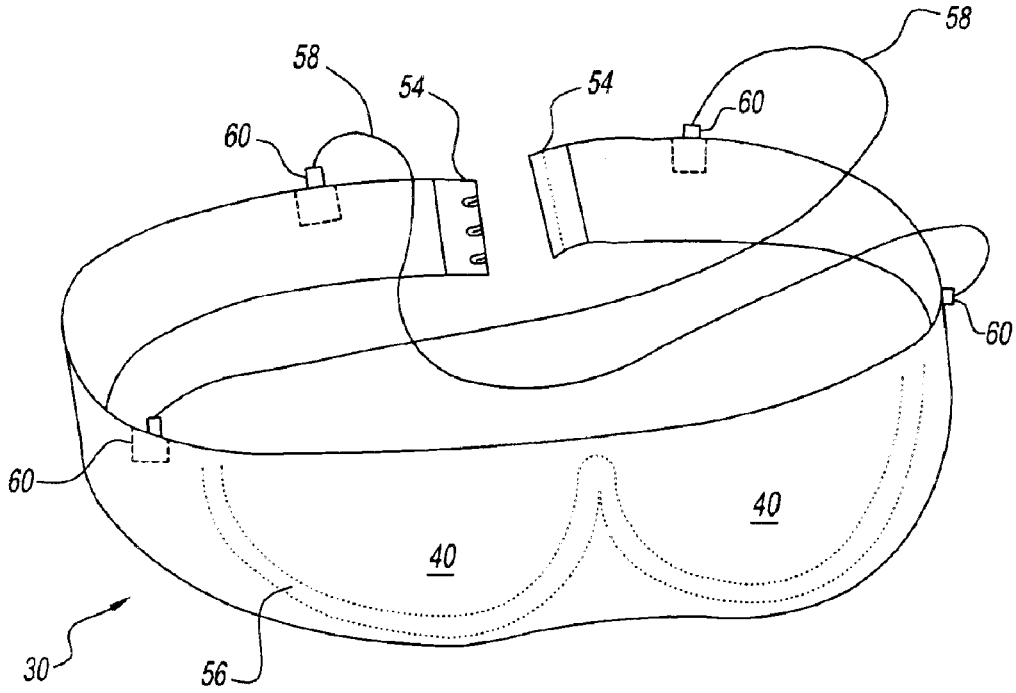
FIGS. 6 and 7 are perspective views of alternate tube bras according to the present invention.
Figure 7:
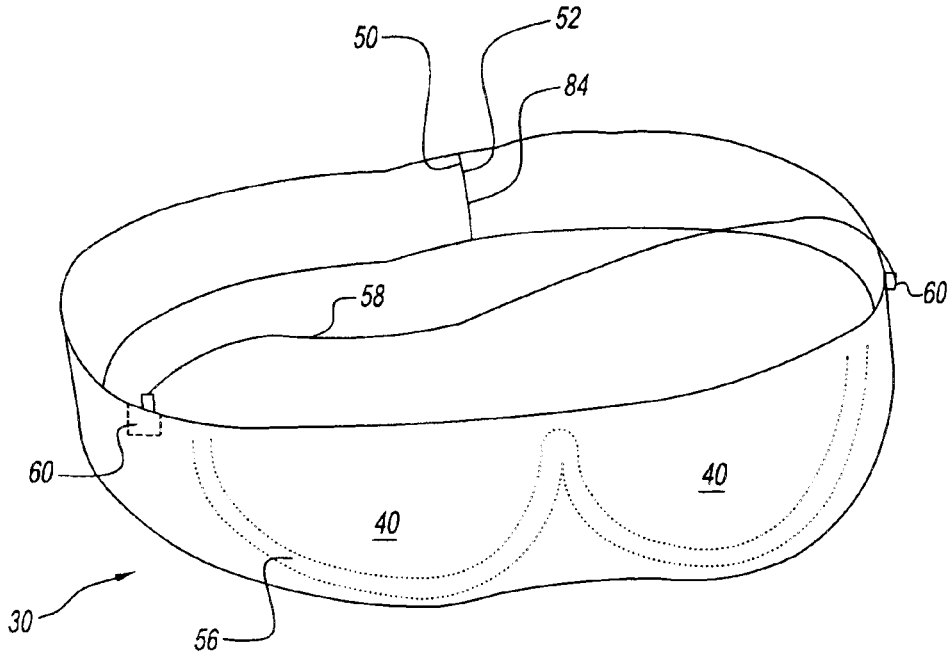

In the embodiment of FIG. 2, tube brassiere 30 has four strap-securing members 60 removably securing two straps 58 to body encircling portion 38. Here, one strap 58 traverses one shoulder, while the other strap 58 traverses the other shoulder. Of course, other configurations of strap-securing members 60 and straps 58 are contemplated by the present invention. Exemplary alternate configurations of strap-securing members 60 and straps 58 are illustrated in FIGS. 6 and 7. For example, straps 58 can be removably connected to strap-securing members 60 in a crisscross manner as in FIG. 6. Also, a single strap 58 can be removably connected to strap-securing members 60 so that the strap traverses around a wearer's neck as in FIG. 7.

Another alternate embodiment of the tube brassiere 30 of the present invention is illustrated in FIG. 7. Here, tube brassiere 30 includes a seam 84 joining ends 50, 52 to one another so that the tube brassiere forms a continuous circle. Thus, fasteners 54 can be eliminated in this embodiment. Seam 84 enables a wearer to easily pull tube brassiere 30 onto or off of their body. Seam 84 can be formed by sewing, fusing, gluing, and others.

Figure 8:
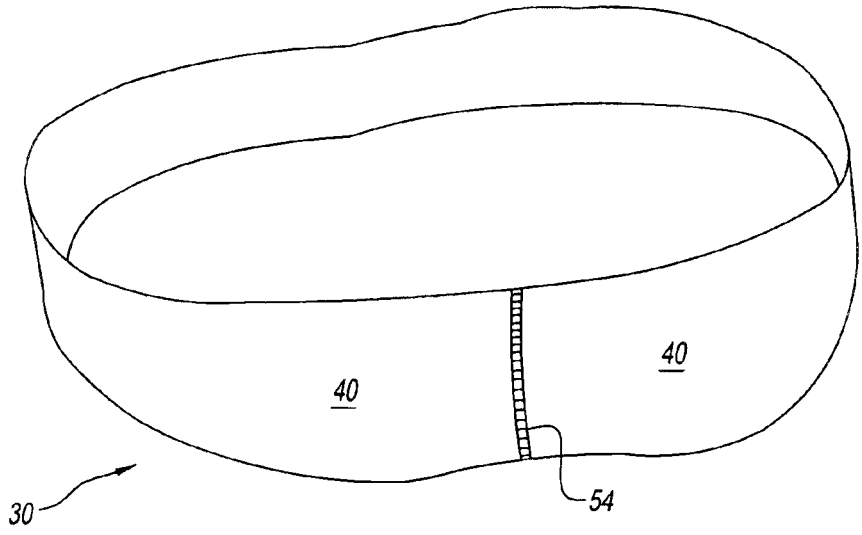
FIG. 8 is a perspective view of an alternate embodiment of a tube brassiere according to the present invention having a front zipper closure.

It should be recognized that fasteners 54 are described above by way of example as being positioned in tube brassiere 30 diametrically opposite the breast cups 40 (e.g., a rear closure). Of course, it is contemplated by the present invention for fasteners 54 to be positioned between breast cups 40 (e.g., a front closure) as illustrated in FIG. 8. Here, fastener 54 is illustrated by way of example as a zipper. Alternately, fasteners 54 can be positioned at any desired position along length 36 (e.g., a side closure).

Tube brassiere 30 can also include labels or other indicia (not shown) that can be sewn or glued to the brassiere by traditional methods. Alternately, the labels or indicia can be transfer printed or direct printed onto the brassiere.

Accordingly, tube brassiere 30 of the present invention is substantially seamless and can be easily manufactured from very few components in very few process steps. Moreover, tube brassiere 30 can be manufactured from cylindrical hosiery blank 32, which is readily available.

It should also be noted that the terms "first", "second", "third", "upper", "lower", and the like may be used herein to modify various elements. These modifiers do not imply a spatial, sequential, or hierarchical order to the modified elements unless specifically stated.

While the present invention has been described with reference to one or more exemplary embodiments, it will be understood by those skilled in the art that various modifications may be made and equivalents may be substituted for elements thereof without departing from the scope of the present invention. In addition, many modifications may be made to adapt a particular situation or material to the teachings of the disclosure without departing from the scope thereof. Therefore, it is intended that the present invention not be limited to the particular embodiment(s) disclosed as the best mode contemplated for carrying out this invention, but that the invention will include all embodiments falling within the scope of the appended claims.

What is claimed is:

1. A tube brassiere comprising:

a circularly knitted garment blank having an internal dimension, a length sufficient to encircle a torso of a wearer, and a pair of breast cups defined in said length, said pair of breast cups having a knitted cup depth, said knitted cup depth being sufficient so that breasts of the wearer are received in said pair of breast cups.

2. The tube brassiere as in claim 1, wherein said circularly knitted garment blank is a hosiery blank.

3. The tube brassiere as in claim 1, wherein said circularly knitted garment blank is formed of a material selected from the group consisting of one or more synthetic materials, one or more natural materials, and any combination thereof.

4. The tube brassiere as in claim 3, wherein said material is nylon.

5. The tube brassiere as in claim 1, further comprising a brassiere component in said internal dimension, said brassiere component being selected from the group consisting of one or more fasteners, underwires, strap securing members, and any combinations thereof.

6. A tube brassiere comprising:

a seamless cylindrical body encircling portion having a length sufficient to encircle a torso of a wearer, a first end, a second end, and an inner dimension;

a pair of breast cups being knit in said body encircling portion to a selected cup depth, said selected cup depth being sufficient so that breasts of the wearer are received in said pair of breast cups;

means for securing said first and second ends to one another so that said body-encircling portion can be retained about said torso.

7. The tube brassiere as in claim 6, wherein said securing means is a seam.

8. The tube brassiere as in claim 6, wherein said securing means comprises a fastener positioned at each of said first and second ends for fastening and unfastening said body-encircling portion about a torso of a wearer.

9. The tube brassiere as in claim 8, wherein each of said fasteners comprises a first portion secured in said inner dimension and a second portion extending from said first and second ends.

10. The tube brassiere as in claim 9, wherein said second portion comprises connecting members selected from the group consisting of one or more hook-and-eye type fasteners, zippers, snaps, and hook-tape strips.

11. The tube brassiere as in claim 9, wherein said first portion is secured in said inner dimension by a heat fusible material or a heat curable adhesive.

12. The tube brassiere as in claim 6, wherein said securing means is in a desired position along said length.

13. The tube brassiere as in claim 12, wherein said desired position is between said pair of breast cups or diametrically opposite said pair of breast cups.

14. The tube brassiere as in claim 6, further comprising at least one brassiere component in said inner dimension, wherein said at least one brassiere component comprises an underwire positioned in said inner dimension proximate said pair of breast cups.

15. The tube brassiere as in claim 14, wherein said underwire is secured in said inner dimension by a heat fusible material or a heat curable adhesive.

16. The tube brassiere as in claim 6, further comprising at least one brassiere component being in said inner dimension, wherein said at least one brassiere component comprises a plurality of strap-securing members each having a first portion in said inner dimension and a second portion extending from said body encircling portion, wherein said second portion of each of said plurality of strap-securing members releasably secures a strap to said body encircling portion.

17. The tube brassiere as in claim 16, wherein said first portion is secured in said inner dimension by a heat fusible material or a heat curable adhesive.

18. A method of making a tube brassiere comprising:

knitting a seamless cylindrical member having a first end, a second end, an internal dimension, and a length defined therebetween;

providing access to said internal dimension through said first end and/or said second end; and knitting a pair of breast cups in said length to a selected depth, wherein said length is sufficient to encircle a torso of a wearer, and wherein said selected depth is sufficient so that breasts of the wearer are received in said pair of breast cups.

19. The method as in claim 18, further comprising seaming said first and second ends to form a continuous circle.

20. The method as in claim 18, further comprising:

inserting a first fastener in said inner dimension at said first end;

inserting a second fastener in said inner dimension at said second end; and securing said first and second fasteners in said inner dimension so that said first and second fasteners can fasten and unfasten said first end to said second end.

21. The method as in claim 18, further comprising securing an underwire in said inner dimension so that said underwire is proximate said pair of breast cups.

22. The method as in claim 18, further comprising securing a first portion of a plurality of strap-securing members in said inner dimension so that a second portion of said plurality of strap-securing members extend from said seamless cylindrical member.

* * * * *